US009386800B2

(12) United States Patent
Sebastian et al.

(10) Patent No.: US 9,386,800 B2
(45) Date of Patent: Jul. 12, 2016

(54) FIBROUS COMPOSITE TOBACCO-CONTAINING MATERIALS

(71) Applicant: R.J. Reynolds Tobacco Company, Winston-Salem, NC (US)

(72) Inventors: Andries D. Sebastian, Clemmons, NC (US); Bruce Bengtsson, Winston-Salem, NC (US); Jason Kobisky, Winston-Salem, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 876 days.

(21) Appl. No.: 13/623,891

(22) Filed: Sep. 21, 2012

(65) Prior Publication Data

US 2014/0083438 A1 Mar. 27, 2014

(51) Int. Cl.

| | |
|---|---|
| ***A24B 13/00*** | (2006.01) |
| ***A24B 13/02*** | (2006.01) |
| ***B65B 29/00*** | (2006.01) |
| ***B65B 51/07*** | (2006.01) |
| ***B65B 51/09*** | (2006.01) |
| ***B65B 51/10*** | (2006.01) |
| ***A24B 15/12*** | (2006.01) |
| ***A24B 15/18*** | (2006.01) |

(52) U.S. Cl.

CPC ..... *A24B 13/00* (2013.01); *A24B 15/12* (2013.01); *A24B 15/186* (2013.01)

(58) Field of Classification Search

USPC ..... 131/111, 290, 347, 352, 353, 366

See application file for complete search history.

(56) References Cited

U.S. PATENT DOCUMENTS

| | | | | |
|---|---|---|---|---|
| 1,376,586 | A | | 5/1921 | Schwartz |
| 1,615,587 | A | | 1/1927 | Klein et al. |
| 2,071,436 | A | * | 2/1937 | Schneider ..... D06M 13/224 427/389.9 |
| 2,435,897 | A | | 2/1948 | Newman |
| 2,733,509 | A | * | 2/1956 | Jurgensen, Jr. ..... A24B 3/14 433/32 |
| 3,222,893 | A | | 7/1962 | Busch et al. |
| 3,368,567 | A | | 2/1968 | Speer |
| 3,696,917 | A | | 10/1972 | Levi |
| 4,015,451 | A | | 4/1977 | Gajjar |
| 4,513,756 | A | | 4/1985 | Pittman et al. |
| 4,528,993 | A | | 7/1985 | Sensabaugh, Jr. et al. |
| 4,606,357 | A | | 8/1986 | Dusek et al. |
| 4,607,479 | A | | 8/1986 | Linden |
| 4,624,269 | A | | 11/1986 | Story et al. |
| 4,631,899 | A | | 12/1986 | Nielsen |
| 4,734,685 | A | | 3/1988 | Watanabe |
| 4,802,498 | A | | 2/1989 | Ogren |
| 4,821,749 | A | | 4/1989 | Toft et al. |
| 4,975,270 | A | | 12/1990 | Kehoe |
| 4,987,907 | A | | 1/1991 | Townsend |
| 4,991,599 | A | | 2/1991 | Tibbetts |
| 5,092,352 | A | | 3/1992 | Sprinkle, III et al. |
| 5,167,244 | A | | 12/1992 | Kjerstad |
| 5,284,031 | A | | 2/1994 | Stoll et al. |
| 5,346,734 | A | | 9/1994 | Wydick, Jr. |
| 5,385,036 | A | | 1/1995 | Spillane et al. |
| 5,387,416 | A | | 2/1995 | White et al. |
| 5,395,684 | A | | 3/1995 | Robinson et al. |
| 5,413,837 | A | | 5/1995 | Rock et al. |
| 5,422,153 | A | | 6/1995 | Miyamoto |
| 5,479,280 | A | | 12/1995 | Kazurov et al. |
| 5,505,117 | A | | 4/1996 | Dunlap et al. |
| 5,543,164 | A | | 8/1996 | Krochta et al. |
| 5,735,145 | A | | 4/1998 | Pernick |
| 6,162,516 | A | | 12/2000 | Derr |
| 6,668,839 | B2 | | 12/2003 | Williams |
| 6,779,369 | B2 | | 8/2004 | Shepherd |
| 6,834,654 | B2 | | 12/2004 | Williams |
| 6,953,040 | B2 | | 10/2005 | Atchley et al. |
| 7,014,039 | B2 | | 3/2006 | Henson et al. |
| 7,032,601 | B2 | | 4/2006 | Atchley et al. |
| 7,060,156 | B2 | | 6/2006 | Mack et al. |
| D592,956 | S | | 5/2009 | Thiellier |
| 7,537,110 | B2 | | 5/2009 | Kutsch et al. |
| D594,154 | S | | 6/2009 | Patel et al. |

(Continued)

FOREIGN PATENT DOCUMENTS

| | | |
|---|---|---|
| WO | WO-2004/095959 | 11/2004 |
| WO | WO-2006/034450 | 3/2006 |
| WO | WO-2007/017761 | 2/2007 |
| WO | WO-2007/067953 | 6/2007 |
| WO | WO 2008/042331 | 4/2008 |
| WO | WO-2010/132444 | 11/2010 |

OTHER PUBLICATIONS

U.S. Appl. No. 13/240,525, filed Sep. 22, 2011, Holton, Jr. et al.

U.S. Appl. No. 13/530,145, filed Jul. 22, 2012, Sebastian et al.

International Search Report for PCT App. No. PCT/US2013/060837 dated Mar. 3, 2014.

*Primary Examiner* — Dennis Cordray

(74) *Attorney, Agent, or Firm* — Womble Carlyle Sandridge & Rice LLP

(57) ABSTRACT

Smokeless tobacco products suitable for oral consumption are provided. The smokeless tobacco products include a tobacco composition and at least one fibrous structure enclosing at least a portion of the outer surface of the tobacco composition such that the fibrous structure and the tobacco composition form a cohesive structure capable of maintaining cohesion when placed in an oral cavity, wherein the fibrous structure includes one or more of (i) a warp knitted structure; (ii) a plurality of reinforcing fibers attached to the tobacco composition; (iii) a braided sleeve; and (iv) a spacer fabric. A process for preparing a smokeless tobacco product adapted for oral consumption is also provided, the process including the step of enclosing at least a portion of the outer surface of a tobacco composition with a fibrous structure to form a composite structure.

27 Claims, 4 Drawing Sheets

(56) References Cited

U.S. PATENT DOCUMENTS

| | | | |
|---|---|---|---|
| 7,584,843 | B2 | 9/2009 | Kutsch et al. |
| 7,611,999 | B2 | 11/2009 | McMurray |
| 7,694,686 | B2 | 4/2010 | Atchley et al. |
| 7,718,249 | B2 | 5/2010 | Russell et al. |
| D625,178 | S | 10/2010 | Bailey et al. |
| 7,810,507 | B2 | 10/2010 | Dube et al. |
| 7,814,625 | B2 | 10/2010 | Russell et al. |
| 7,819,124 | B2 | 10/2010 | Strickland et al. |
| 7,861,728 | B2 | 1/2011 | Holton, Jr. et al. |
| 7,942,993 | B2 | 5/2011 | Gessler et al. |
| 7,946,296 | B2 | 5/2011 | Wrenn et al. |
| 7,946,450 | B2 | 5/2011 | Gelardi et al. |
| 8,033,425 | B2 | 10/2011 | Gelardi |
| 8,048,466 | B2 | 11/2011 | McHugh et al. |
| 8,061,362 | B2 | 11/2011 | Mua et al. |
| 8,066,123 | B2 | 11/2011 | Gelardi |
| 8,067,046 | B2 | 11/2011 | Schleef et al. |
| 8,151,802 | B2 | 4/2012 | Boldrini |
| 2004/0020503 | A1 | 2/2004 | Williams |
| 2004/0118422 | A1 | 6/2004 | Lundin et al. |
| 2004/0217024 | A1 | 11/2004 | Arnarp et al. |
| 2005/0061339 | A1 | 3/2005 | Hansson et al. |
| 2005/0115580 | A1 | 6/2005 | Quinter et al. |
| 2005/0244521 | A1 | 11/2005 | Strickland et al. |
| 2006/0118589 | A1 | 6/2006 | Arnarp et al. |
| 2006/0191548 | A1 | 8/2006 | Strickland et al. |
| 2007/0062549 | A1 | 3/2007 | Holton, Jr. et al. |
| 2007/0261707 | A1 | 11/2007 | Winterson et al. |
| 2008/0029110 | A1 | 2/2008 | Dube et al. |
| 2008/0029116 | A1 | 2/2008 | Robinson et al. |
| 2008/0029117 | A1 | 2/2008 | Mua et al. |
| 2008/0173317 | A1 | 7/2008 | Robinson et al. |
| 2008/0196730 | A1 | 8/2008 | Engstrom et al. |
| 2008/0202536 | A1 | 8/2008 | Torrence et al. |
| 2008/0209586 | A1 | 8/2008 | Nielsen et al. |
| 2008/0305216 | A1 | 12/2008 | Crawford et al. |
| 2009/0014343 | A1 | 1/2009 | Clark et al. |
| 2009/0014450 | A1 | 1/2009 | Bjorkholm |
| 2009/0025738 | A1 | 1/2009 | Mua et al. |
| 2009/0065013 | A1 | 3/2009 | Essen et al. |
| 2009/0133703 | A1 | 5/2009 | Strickland et al. |
| 2009/0133704 | A1 | 5/2009 | Strickland et al. |
| 2009/0230003 | A1 | 9/2009 | Thiellier |
| 2009/0250360 | A1 | 10/2009 | Bellamah |
| 2009/0293889 | A1 | 12/2009 | Kumar et al. |
| 2010/0084424 | A1 | 4/2010 | Gelardi |
| 2010/0126652 | A1 | 5/2010 | Joern et al. |
| 2010/0133140 | A1 | 6/2010 | Bailey et al. |
| 2010/0170522 | A1 | 7/2010 | Sun et al. |
| 2010/0264157 | A1 | 10/2010 | Bailey et al. |
| 2010/0291245 | A1 | 11/2010 | Gao et al. |
| 2010/0300463 | A1 | 12/2010 | Chen et al. |
| 2010/0300464 | A1 | 12/2010 | Gee et al. |
| 2010/0303969 | A1 | 12/2010 | Sengupta et al. |
| 2011/0061666 | A1 | 3/2011 | Dube et al. |
| 2011/0139164 | A1 | 6/2011 | Mua et al. |
| 2011/0168712 | A1 | 7/2011 | Bailey et al. |
| 2011/0204074 | A1 | 8/2011 | Gelardi et al. |
| 2011/0236442 | A1 | 9/2011 | Miser et al. |
| 2011/0247640 | A1 | 10/2011 | Beeson et al. |
| 2011/0315154 | A1 | 12/2011 | Mua et al. |
| 2012/0024301 | A1 | 2/2012 | Carroll et al. |
| 2012/0031414 | A1* | 2/2012 | Atchley ..... A24B 13/00 131/118 |
| 2012/0031416 | A1 | 2/2012 | Atchley et al. |
| 2012/0037175 | A1 | 2/2012 | Cantrell et al. |
| 2012/0055493 | A1 | 3/2012 | Novak et al. |
| 2012/0055494 | A1 | 3/2012 | Hunt et al. |
| 2012/0103353 | A1 | 5/2012 | Sebastian et al. |
| 2012/0118310 | A1 | 5/2012 | Cantrell et al. |
| 2012/0138073 | A1 | 6/2012 | Cantrell et al. |
| 2012/0138074 | A1 | 6/2012 | Cantrell et al. |
| 2013/0186416 | A1 | 7/2013 | Gao et al. |
| 2013/0186417 | A1 | 7/2013 | Gao et al. |
| 2013/0186418 | A1 | 7/2013 | Gao et al. |
| 2013/0186419 | A1 | 7/2013 | Gao et al. |

* cited by examiner

FIBROUS COMPOSITE TOBACCO-CONTAINING MATERIALS

FIELD OF THE DISCLOSURE

The present invention relates to products made or derived from tobacco, or that otherwise incorporate tobacco, and are intended for human consumption. More particularly, the disclosure relates to fibrous structures for encapsulating tobacco products adapted for oral consumption.

BACKGROUND OF THE DISCLOSURE

Tobacco may be enjoyed in a so-called "smokeless" form. Particularly popular smokeless tobacco products are employed by inserting some form of processed tobacco or tobacco-containing formulation into the mouth of the user. See, for example, the types of smokeless tobacco formulations, ingredients, and processing methodologies set forth in U.S. Pat. No. 1,376,586 to Schwartz; U.S. Pat. No. 3,696,917 to Levi; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,991,599 to Tibbetts; U.S. Pat. No. 4,987,907 to Townsend; U.S. Pat. No. 5,092,352 to Sprinkle, III et al.; U.S. Pat. No. 5,387,416 to White et al.; U.S. Pat. No. 6,668,839 to Williams; U.S. Pat. No. 6,834,654 to Williams; U.S. Pat. No. 6,953,040 to Atchley et al.; U.S. Pat. No. 7,032,601 to Atchley et al.; U.S. Pat. No. 7,694,686 to Atchley et al.; U.S. Pat. No. 7,810,507 to Dube et al.; U.S. Pat. No. 7,819,124 to Strickland et al.; U.S. Pat. No. 7,861,728 to Holton, Jr. et al.; U.S. Pat. No. 7,946,296 to Wrenn et al. U.S. Pat. No. 8,067,046 to Schleef et al.; and U.S. Pat. No. 8,151,802 to Boldrini et al.; US Pat. Pub. Nos. 2004/0020503 to Williams; 2005/0115580 to Quinter et al.; 2005/0244521 to Strickland et al.; 2006/0191548 to Strickland et al.; 2007/0062549 to Holton, Jr. et al.; 2007/0261707 to Winterson et al.; 2008/0029110 to Dube et al.; 2008/0029116 to Robinson et al.; 2008/0029117 to Mua et al.; 2008/0173317 to Robinson et al.; 2008/0196730 to Engstrom et al.; 2008/0209586 to Neilsen et al.; 2008/0305216 to Crawford et al.; 2009/0065013 to Essen et al.; 2009/0133703 and 2009/0133704 to Strickland; 2009/0293889 to Kumar et al.; 2010/0170522 to Sun et al.; 2010/0291245 to Gao et al.; 2010/0300463 to Chen et al.; 2010/0300464 to Gee et al.; 2010/0303969 to Sengupta et al.; 2011/0061666 to Dube et al.; 2011/0139164 to Mua et al.; 2011/0247640 to Beeson et al.; 2011/0315154 to Mua et al.; 20120024301 to Carroll et al.; 2012/0031414 and 2012/0031416 to Atchley et al.; 2012/0037175 to Cantrell et al.; 2012/0055493 to Novak, III et al.; 2012/0055494 to Hunt et al.; 2012/0103353 to Sebastian et al.; 2012/0118310 to Cantrell et al.; 2012/0138073 to Cantrell et al.; and 2012/0138074 to Cantrell et al.; PCT Pub. Nos. WO 04/095959 to Arnarp et al.; and WO 10/132,444 to Atchley; each of which is incorporated herein by reference.

Representative smokeless tobacco products that have been marketed include those referred to as CAMEL Snus, CAMEL Orbs, CAMEL Strips and CAMEL Sticks by R. J. Reynolds Tobacco Company; GRIZZLY moist tobacco, KODIAK moist tobacco, LEVI GARRETT loose tobacco and TAYLOR'S PRIDE loose tobacco by American Snuff Company, LLC; KAYAK moist snuff and CHATTANOOGA CHEW chewing tobacco by Swisher International, Inc.; REDMAN chewing tobacco by Pinkerton Tobacco Co. LP; COPENHAGEN moist tobacco, COPENHAGEN Pouches, SKOAL Bandits, SKOAL Pouches, RED SEAL long cut and REVEL Mint Tobacco Packs by U.S. Smokeless Tobacco Company; and MARLBORO Snus and Taboka by Philip Morris USA.

It would thus be desirable to provide an improved means for delivering compact or compressed amounts of smokeless tobacco wherein the means of delivery provides various advantageous features, such as ease of dispensing, use, and an overall enjoyable form.

BRIEF SUMMARY OF THE DISCLOSURE

The present invention provides tobacco products adapted for oral ingestion and processes for manufacturing the same. The tobacco product includes a tobacco composition and at least one fibrous structure adapted to encapsulate or enclose the tobacco composition such that the fibrous structure enhances the cohesiveness of the tobacco composition within the tobacco product. The presence of the fibrous structure enables the resulting composite product to maintain cohesion between the fibrous structure and the tobacco composition when placed in the oral cavity of the user, meaning the products of the invention are capable of remaining essentially intact during oral use. According to one embodiment, the tobacco composition includes at least one of a cut, ground, pelletized, particulate, granular, shredded, reconstituted, extruded, cast, or compressed tobacco sheet material.

According to one aspect, the fibrous structure includes one or more of (i) a warp knitted structure; (ii) a plurality of reinforcing fibers attached to the tobacco composition; (iii) a braided sleeve; and (iv) a spacer fabric. According to one embodiment, the fibrous structure includes fibers made from alginate, protein, cotton, nylon, viscose, polyester, acrylics, flax, jute, bamboo, rayon, polyvinyl alcohol, starch, polyurethane, cis-polyisoprene, polyanhydride, polybutylene succinate, hybrid yarns formed containing glass fiber, and copolymers and blends thereof. According to another embodiment, the fibrous structure includes fibers made from a cellulosic material or an aliphatic polyester selected from polylactic acid and polyhydroxyalkanoates. According to one embodiment, the fibrous structure encloses at least about 50% of the outer surface area of the tobacco composition or at least about 90% of the outer surface area of the tobacco composition.

In certain embodiments, the fibrous structure includes a plurality of reinforcing fibers attached to the tobacco composition through a tailored fiber placement (TFP) process. According to another embodiment, the fibrous structure includes a spacer fabric that includes two fabric layers joined together by a plurality of intermediate fibers and defining voids between the two fabric layers, wherein the tobacco composition is positioned within the voids of the spacer fabric. According to yet another embodiment, the tobacco product further includes an edible film. The edible film at least partially encapsulates the tobacco composition, and the fibrous structure typically encapsulates the edible film. In a still further embodiment, the product contains at least one edible film or fabric sheet (or a plurality of either material or a combination of an edible film with a fabric sheet) positioned adjacent to the tobacco composition to form a multi-layer structure, and a plurality of reinforcing fibers are positioned on the surface of the multi-layer structure and attached thereto, such as by using a tailored fiber placement process.

According to another aspect, a process for preparing a smokeless tobacco product adapted for oral consumption is provided. The process includes the step of enclosing at least a portion of the outer surface of a tobacco composition with a fibrous structure to form a composite structure capable of maintaining cohesion when placed in an oral cavity, wherein the fibrous structure includes one or more of (i) a warp knitted structure; (ii) a plurality of reinforcing fibers attached to the tobacco composition; (iii) a braided sleeve; and (iv) a spacer fabric. According to one embodiment, the fibrous structure includes a warp knitted structure and the enclosing step includes placing the tobacco composition within a cavity formed within the warp knitted structure and compressing the warp knitted structure around the tobacco composition. According to another embodiment, the fibrous structure includes a plurality of reinforcing fibers attached to the tobacco composition through a tailored fiber placement (TFP) process that includes the step of stitching each reinforcing fiber to the tobacco composition. According to yet another embodiment, the fibrous structure includes a braided sleeve, and wherein the enclosing step includes placing the tobacco composition within a cavity formed within the braided sleeve and compressing the braided sleeve around the tobacco composition. According to a still further embodiment, the fibrous structure includes a spacer fabric, and the enclosing step includes placing the tobacco composition within the spacer fabric and collapsing the spacer fabric around the tobacco composition. The spacer fabric can include two fabric layers joined together by a plurality of intermediate fibers and defining voids between the two fabric layers, and the enclosing step can include placing the tobacco composition within the voids of the spacer fabric. In a further version of a method utilizing a tailored fiber placement (TFP) process, wherein the composite structure further comprises at least one edible film or fabric sheet positioned adjacent to the tobacco composition to form a multi-layer structure, the tailored fiber placement process comprises positioning the plurality of reinforcing fibers on the surface of the multi-layer structure and stitching each reinforcing fiber thereto.

These and other features, aspects, and advantages of the disclosure will be apparent from a reading of the following detailed description together with the accompanying drawings, which are briefly described below.

BRIEF DESCRIPTION OF THE DRAWINGS

Figure 1:
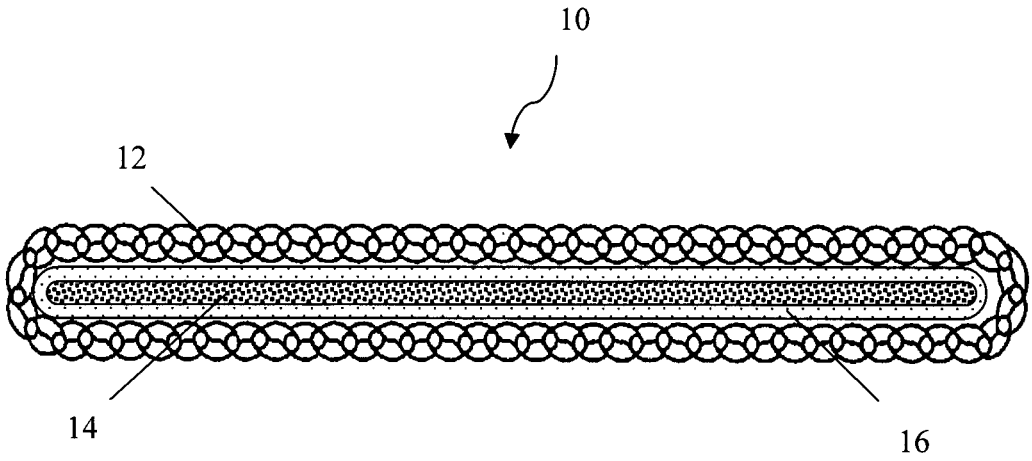
Figure 2:
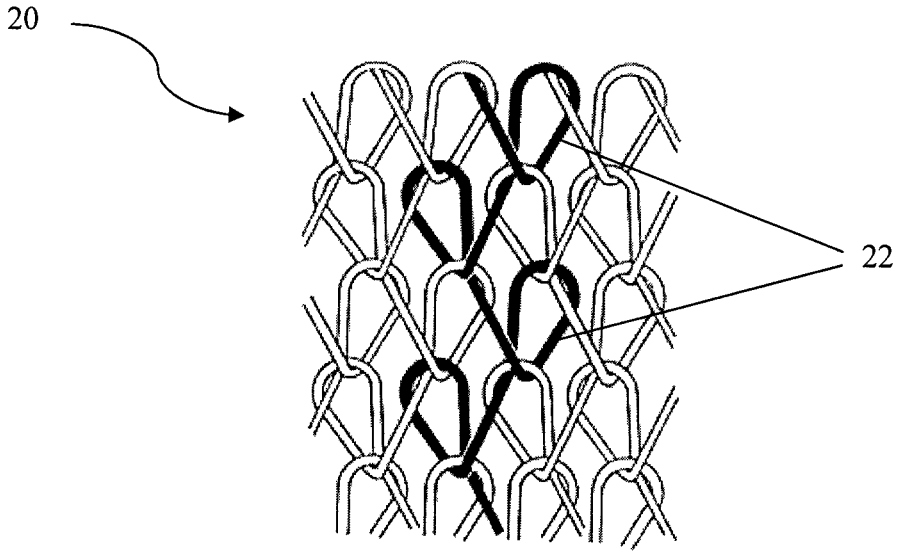
Figure 3:
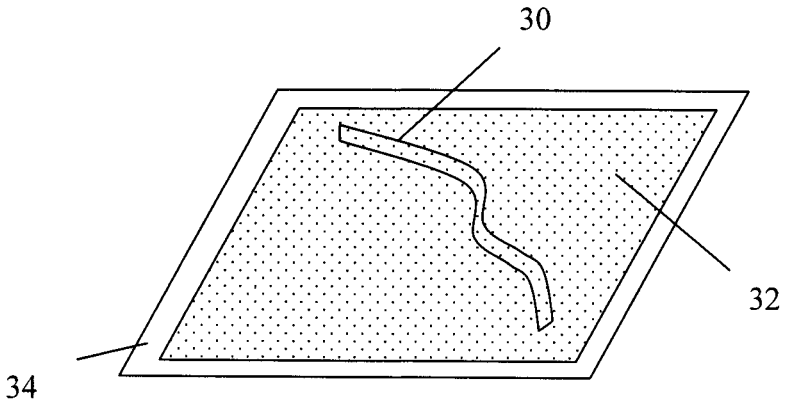
Figure 4:
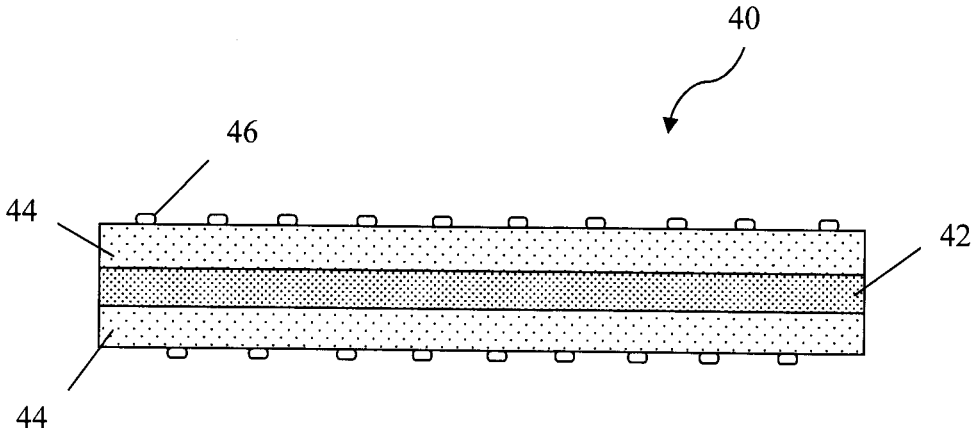
Figure 5:
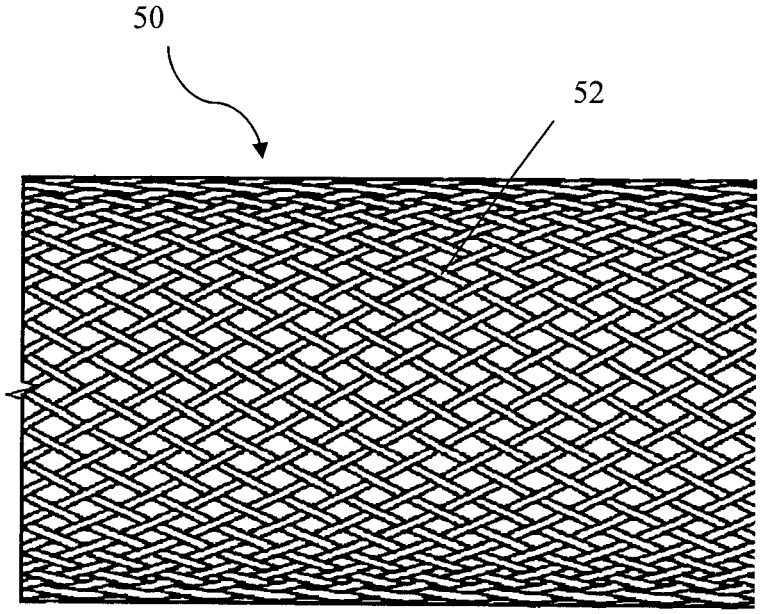
Figure 6:
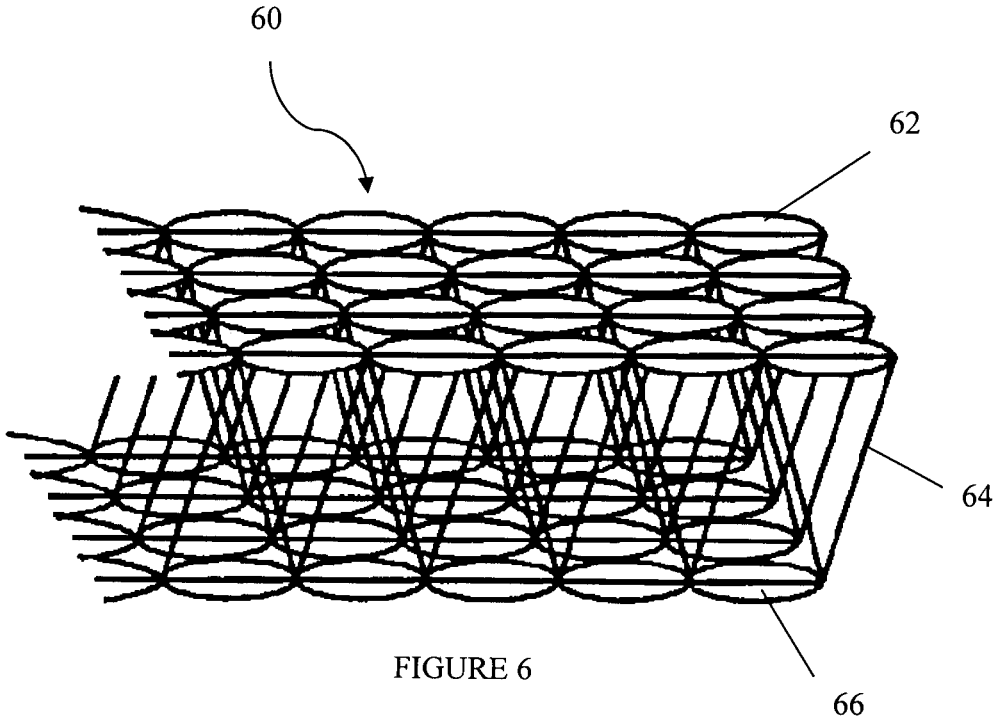
Figure 7:
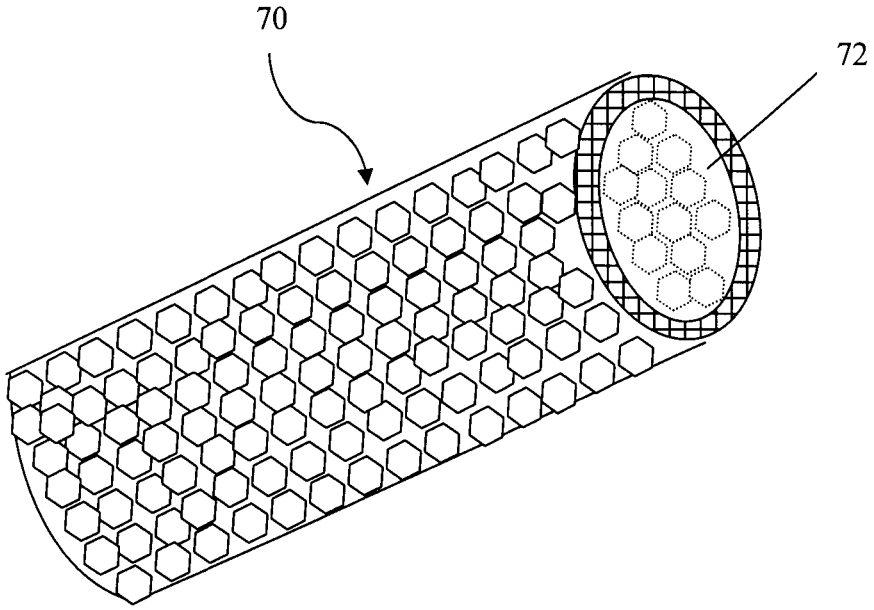

Having thus described the disclosure in general terms, reference will now be made to the accompanying drawings, which are not necessarily drawn to scale, and wherein:

FIG. 1 is a cross-sectional view of one embodiment of a smokeless tobacco product of the present disclosure;

FIG. 2 is an expanded view of a warp knitted fabric according to one embodiment;

FIG. 3 illustrates the placement of a reinforcing fiber on a base material according to tailored fiber placement process;

FIG. 4 is a cross-sectional view of a multi-layer smokeless tobacco product that includes a plurality of reinforcing fibers attached through a tailored fiber placement (TFP) process;

FIG. 5 is a side view of a braided sleeve according to one embodiment;

FIG. 6 is a cross-sectional view of a spacer fabric according to one embodiment; and FIG. 7 is a perspective view of a tubular spacer fabric according to one embodiment.

DETAILED DESCRIPTION OF THE DISCLOSURE

The present disclosure now will be described more fully hereinafter with reference to certain preferred aspects. These aspects are provided so that this disclosure will be thorough and complete, and will fully convey the scope of the disclosure to those skilled in the art. Indeed, the disclosure may be embodied in many different forms and should not be construed as limited to the aspects set forth herein; rather, these aspects are provided so that this disclosure will satisfy applicable legal requirements. As used in the specification, and in the appended claims, the singular forms "a", "an", "the", include plural referents unless the context clearly dictates otherwise.

A composite smokeless tobacco product adapted for oral consumption is provided. According to one embodiment, the tobacco product includes a tobacco composition and at least one fibrous structure adapted to encapsulate or enclose the tobacco composition such that the fibrous structure enhances the cohesiveness of the tobacco composition within the tobacco product. The presence of the fibrous structure enables the composite product to maintain cohesion between the fibrous structure and the tobacco composition when placed in the oral cavity of the user, meaning the products of the invention are capable of remaining essentially intact during oral use. The composite structure is adapted for oral usage and may incorporate various fibers or yarns as disclosed herein. The overall or cross-sectional shape of the smokeless tobacco product of the invention can vary, and will include ovals, circles, squares, rectangles, triangles, trapezoids, or any other shape suitable for placement between the cheek and gum.

Reference to various forms of "enclosure" or "encapsulation" of the tobacco composition refers to the ability of the fibrous structure to encompass, adhere to, or be applied on or around a tobacco composition, particularly in the context of a pocket, pouch, or sleeve. The composite structure will not necessarily encapsulate all surfaces of a tobacco composition such that the fibrous structure forms the entire outer surface of the composition, although such structures are included in the invention. The fibrous structure could simply be present as part of a multi-layer structure such that a significant portion of the outer surface of a tobacco composition layer is overlaid with the fibrous structure, but the tobacco composition is still open to the outer surface of the product, such as at the lateral edges of a multi-layer product. In certain embodiments, the fibrous structure encompasses or surrounds at least about 50% of the outer surface area of the tobacco composition, more often at least about 60%, at least about 70%, at least about 80%, at least about 90%, at least about 95%, or even 100% of the outer surface area (i.e., the tobacco composition is entirely surrounded by the fibrous structure).

The composite structures disclosed herein aid in the delivery of tobacco products which are convenient, fresh and flavorful. The fibrous structures described herein are safe for oral usage such that once the fibrous structure is in combination with a tobacco composition, the resulting tobacco product may be stored, packaged, and delivered to the end user for placement in the oral cavity. The various fibrous structures disclosed herein can be used alone or in any combination with one another.

As used herein, the term "tobacco composition" includes, but is not limited to, compositions comprising pelletized, particulate, granular, shredded, and reconstituted tobacco (e.g., compressed or molded pellets produced from powdered or processed tobacco, such as those formed into the general shape of a coin, cylinder, bean, pellet, sphere, orb, strip, obloid, cube, bead, or the like), extruded or cast pieces of tobacco products incorporating tobacco carried by a solid substrate (e.g., where substrate materials range from edible grains to inedible cellulosic sticks), extruded or formed tobacco-containing rods or sticks, compressed tobacco sheets, tobacco-containing capsule-like materials having an outer shell region and an inner core region, straw-like (e.g., hollow formed) tobacco-containing shapes, sachets or packets containing tobacco (e.g., snus-like products), pieces of tobacco-containing gum, and the like. Further, exemplary tobacco compositions include tobacco formulations in a loose form such as, for example, a moist snuff product. Exemplary loose form tobacco used with the containers of the present disclosure may include tobacco formulations associated with, for example, commercially available GRIZZLY moist tobacco products and KODIAK moist tobacco products that are marketed by American Snuff Company, LLC. The tobacco composition used in the products of the invention can also include a tobacco extract, such as an aqueous tobacco extract. Such extracts can be used in liquid or solid form (e.g., freeze-dried or spray-dried form). Tobacco extracts used in the present invention can be treated (e.g., by ultrafiltration, microfiltration, nanofiltration, size exclusion chromatography, reverse osmosis, or combinations thereof) as described, for example, in U.S. patent application Ser. No. 13/240,525 to Holton Jr. et al., filed Sep. 22, 2011, which is incorporated herein by reference. Multiple types of tobacco composition can be used in the same product, such as combinations of a reconstituted tobacco or particulate tobacco with a tobacco extract.

Exemplary smokeless tobacco compositions capable of use with the present disclosure are set forth in, for example, U.S. Pat. No. 1,376,586 to Schwartz; U.S. Pat. No. 3,368,567 to Speer; U.S. Pat. No. 4,513,756 to Pittman et al.; U.S. Pat. No. 4,606,357 to Dusek et al; U.S. Pat. No. 4,821,749 to Toft et al.; U.S. Pat. No. 5,167,244 to Kjerstad; U.S. Pat. No. 5,387,416 to White; U.S. Pat. No. 6,668,839 to Williams; U.S. Pat. No. 7,810,507 to Dube et al.; U.S. Pat. No. 7,819,124 to Strickland et al.; U.S. Patent Pub. Nos. 2005/0244521 to Strickland et al.; 2006/0191548 to Strickland et al.; and 2008/0029116 to Robinson et al. Examples of tobacco-containing gum are set forth in U.S. Pat. No. 4,624,269 to Story et al.; U.S. Pat. No. 4,975,270 to Kehoe; and U.S. Pat. No. 4,802,498 to Ogren. All of the above-cited references are incorporated by reference herein in their entirety.

According to one embodiment, the tobacco composition encapsulated within a fibrous structure according to the invention can be contained within an existing pouch or bag. Such products include the type commonly used for the manufacture of snus types of products (e.g., a sealed, moisture permeable pouch that is sometimes referred to as a "portion"). A representative moisture permeable pouch can be composed of a "fleece" type of material. The tobacco composition is in turn contained within a package that is sealed tightly, and is composed of a suitable material, such that the atmospheric conditions within that sealed package are modified and/or controlled. Descriptions of various components of snus products and components thereof also are set forth in US Pat. Pub. No. 2004/0118422 to Lundin et al., which is incorporated herein by reference. See, also, for example, U.S. Pat. No. 4,607,479 to Linden; U.S. Pat. No. 4,631,899 to Nielsen; U.S. Pat. No. 5,346,734 to Wydick et al.; and U.S. Pat. No. 6,162,516 to Derr, and US Pat. Pub. No. 2005/0061339 to Hansson et al.; each of which is incorporated herein by reference. See, also, the representative types of pouches, and pouch material or fleece, set forth in U.S. Pat. No. 5,167,244 to Kjerstad, which is incorporated herein by reference. Snus products can be manufactured using equipment such as that available as SB 51-1/T, SBL 50 and SB 53-2/T from Merz Verpackungmaschinen GmbH. G.D SpA out of Italy also supplies tobacco pouching equipment. Snus pouches can be provided as individual pouches, or a plurality of pouches and can be connected or linked together (e.g., in an end-to-end manner) such that a single pouch or individual portion can be readily removed for use from a one-piece strand or matrix of pouches.

Tobaccos used for the manufacture of tobacco products pursuant to the present invention may vary. The tobaccos may include types of tobaccos such as flue-cured tobacco, burley tobacco, Oriental tobacco, Maryland tobacco, dark tobacco, dark-fired tobacco, dark air cured (e.g., passanda, cubano, jatin and bezuki tobaccos) or light air cured (e.g., North Wisconsin and galpoa tobaccos), and Rustica tobaccos, as well as other rare or specialty tobaccos. Descriptions of various types of tobaccos, growing practices, harvesting practices and curing practices are set forth in Tobacco Production, Chemistry and Technology, Davis et al. (Eds.) (1999), which is incorporated herein by reference. See, also, the types and forms of tobacco set forth in U.S. Pat. No. 7,810,507 to Dube et al. and U.S. Pat. No. 8,061,362 to Mua et al., which are incorporated by reference in their entirety.

If desired, the tobacco materials can be irradiated, pasteurized, or otherwise subjected to controlled heat treatment. Such treatment processes are detailed, for example, in US Pat. Pub. No. 2009/0025738 to Mua et al., which is incorporated herein by reference. A tobacco material (or a tobacco composition comprising a tobacco material) can be thermally treated by mixing the tobacco material (or composition thereof), water, and an additive selected from the group consisting of lysine, glycine, histidine, alanine, methionine, glutamic acid, aspartic acid, proline, phenylalanine, valine, arginine, di- and trivalent cations, asparaginase, saccharides, phenolic compounds, reducing agents, compounds having a free thiol group, oxidizing agents (e.g., hydrogen peroxide), oxidation catalysts, plant extracts, and combinations thereof, to form a moist tobacco mixture; and heating the moist tobacco mixture at a temperature of at least about 60° C. to form a heat-treated tobacco mixture. In one embodiment, the tobacco extract is heat treated in the presence of water, NaOH, and an additive (e.g., lysine) at about 88° C. for about 60 minutes. Such heat treatment can help prevent acrylamide production resulting from reaction of asparagine with reducing sugars in tobacco materials and can provide some degree of pasteurization. See, for example, US Pat. Pub. No. 2010/0300463 to Chen et al., which is incorporated herein by reference.

Further components can be admixed with, or otherwise incorporated within, the tobacco compositions according to the invention. The additives can be artificial, or can be obtained or derived from herbal or biological sources. Exemplary types of additives include salts (e.g., sodium chloride, potassium chloride, sodium citrate, potassium citrate, sodium acetate, potassium acetate, and the like), natural sweeteners (e.g., fructose, sucrose, glucose, maltose, vanillin, ethylvanillin glucoside, mannose, galactose, lactose, and the like), artificial sweeteners (e.g., sucralose, saccharin, aspartame, acesulfame K, neotame and the like), organic and inorganic fillers (e.g., grains, processed grains, puffed grains, maltodextrin, dextrose, calcium carbonate, calcium phosphate, corn starch, lactose, manitol, xylitol, sorbitol, finely divided cellulose, and the like), binders (e.g., povidone, sodium carboxymethylcellulose and other modified cellulosic types of binders, sodium alginate, xanthan gum, starch-based binders, gum arabic, lecithin, and the like), pH adjusters or buffering agents (e.g., metal hydroxides, preferably alkali metal hydroxides such as sodium hydroxide and potassium hydroxide, and other alkali metal buffers such as metal carbonates, preferably potassium carbonate or sodium carbonate, or metal bicarbonates such as sodium bicarbonate, and the like), colorants (e.g., dyes and pigments, including caramel coloring and titanium dioxide, and the like), humectants (e.g., glycerin, propylene glycol, and the like), oral care additives (e.g., thyme oil, eucalyptus oil, and zinc), preservatives (e.g., potassium sorbate, and the like), syrups (e.g., honey, high fructose corn syrup, and the like), disintegration aids (e.g., microcrystalline cellulose, croscarmellose sodium, crospovidone, sodium starch glycolate, pregelatinized corn starch, and the like), flavorant and flavoring mixtures (e.g., vanilla, coffee, chocolate, cream, mint, spearmint, menthol, peppermint, wintergreen, lavender, cardamon, nutmeg, cinnamon, clove, cascarilla, sandalwood, honey, jasmine, ginger, anise, sage, licorice, lemon, orange, apple, peach, lime, cherry, eucalyptus, strawberry, or mixtures thereof), antioxidants, and mixtures thereof. If desired, the additive can be microencapsulated as set forth in US Patent Appl. Pub. No. 2008/0029110 to Dube et al., which is incorporated by reference herein. In addition, exemplary encapsulated additives are described, for example, in WO 2010/132444 A2 to Atchley, which has been previously incorporated by reference herein. Exemplary smokeless tobacco components are set forth in US Patent Appl. Pub. Nos. 2012/0037175 to Cantrell et al.; 2012/0055494 to Hunt et al.; 2012/0103353 to Sebastian et al.; 2012/0118310 to Cantrell et al.; 2012/0138073 to Cantrell et al.; and 2012/0138074 to Cantrell et al., which is incorporated by reference herein.

As used herein, the term "fibrous structure" refers to a fibrous material capable of forming a structure suitable for encapsulation of a tobacco composition such as, for example, a smokeless tobacco composition, and which is suitable for human consumption. The fibrous structures as disclosed herein may be manufactured from a variety of stable natural, semi-synthetic, and synthetic fibers or yarns that are suitable for oral usage and capable of comfortably conforming to the area between the gum and cheek or lip. The fibrous structure incorporated structural elements that are distinct from the fleece-like materials conventionally associated with snus products. Suitable materials include, for example, alginate, protein (e.g., soy, milk), cotton, nylon, viscose, polyester (including aliphatic polyesters), acrylics, flax, jute, bamboo, rayon, polyvinyl alcohol, starch, aliphatic polyurethanes, cis-polyisoprene, polyanhydrides, polybutylene succinate, and copolymers and blends thereof, as well as hybrid yarns formed from high performance fibers such as glass fiber. In one embodiment, the fibrous material is a cellulosic material, such as regenerated cellulose, cellulose acetate, cellulose triacetate, cellulose nitrate, ethyl cellulose, cellulose acetate propionate, cellulose acetate butyrate, hydroxypropyl cellulose, methyl hydroxypropyl cellulose, and the like. Exemplary aliphatic polyesters include polyglycolic acid (PGA), polylactic acid (PLA) (e.g., poly(L-lactic acid) or poly(DL-lactic acid)), polyhydroxyalkanoates (PHAs) such as polyhydroxypropionate, polyhydroxyvalerate, polyhydroxybutyrate, polyhydroxyhexanoate, and polyhydroxyoctanoate, polycaprolactone (PCL), polybutylene succinate, polybutylene succinate adipate, and copolymers thereof (e.g., polyhydroxybutyrate-co-hydroxyvalerate (PHBV)). The chosen material may vary depending on the chosen manufacturing technique and the desired properties (e.g., desired level of biodegradability). According to one embodiment, the fiber or yarn has a linear mass density of typically from about 1.5 denier to about 50 denier.

The thickness of the fibrous structures described herein may vary, but will typically be of sufficient thickness to provide rigidity, strength, and support to the tobacco composition (e.g., a loose or compressed tobacco composition) and to remain intact during oral use. The thickness of the fibrous structures (and the overall composite product) can also depend on the desired taste level or feel within the user's mouth.

Any of the further components or additives noted above with respect to the tobacco composition could also be added to the fibrous structure portion of the composite structure of the invention, such as in the form of a coating or even imbedded in the fibrous material. In particular, flavorants could be incorporated into the fibrous structure to further enhance the sensory characteristics of the product.

The manner in which the fibrous structure and the tobacco composition are combined to form the smokeless tobacco product can vary. Typically, the process involves enwrapping or encircling a tobacco composition with a fibrous structure to at least partially enclose the tobacco composition. The fibrous structure and the tobacco composition are typically brought into intimate contact such that the combination forms a cohesive product. In certain embodiments, the fibrous structure will be preformed into a pouch-like or cylindrical shape that defines an interior compartment and the tobacco composition can be placed within the interior compartment. Thereafter, the fibrous structure can be compressed around the tobacco composition and the opening can be stitched closed or otherwise shut to prevent leakage of the tobacco composition from the fibrous structure. In other embodiments, the tobacco composition is placed on a fibrous structure in flat, sheet-like form and thereafter the fibrous structure is wrapped around the tobacco composition and secured.

The size of the openings present in the fibrous structure (e.g., the size of openings in a knitted or braided mesh) can vary, but will typically be small enough to prevent significant leakage of the tobacco composition from the product. The size necessary to accomplish this function will vary depending on the structure of the tobacco composition. A finely-divided particulate tobacco composition will require smaller mesh openings than a compressed tobacco sheet.

The relative amount of the fibrous structure and the tobacco composition can vary widely depending on the desired properties of the final product. Typically, the fibrous structure will contribute about 1 to about 99 percent by weight (e.g., about 10 to about 80 percent by weight) of the smokeless tobacco product. In certain embodiments, the fibrous structure is the predominate component of the product, such as in the case of products comprising more than about 50 percent by weight of fibrous structure based on the total weight of the product (e.g., products containing greater than about 60 percent by weight or greater than about 70 percent by weight of the fibrous structure). In other embodiments, the tobacco composition is the predominate component, such as in the case of products comprising more than about 50 percent by weight of tobacco composition based on the total weight of the product (e.g., products containing greater than about 60 percent by weight or greater than about 70 percent by weight of the tobacco composition).

Typically, the amount of tobacco composition within each individual portion (e.g., within each composite product) is such that there is at least about 50 mg, often at least about 150 mg, and frequently at least about 250 mg, of dry weight tobacco; and less than about 700 mg, often less than about 500 mg, and frequently less than about 300 mg, of dry weight tobacco. In one typical embodiment, the amount of tobacco composition within each composite product is between about 100 mg and about 400 mg.

FIG. 1 provides a cross-sectional view of an embodiment of a smokeless tobacco product 10 of the present disclosure. As illustrated, the tobacco product 10 includes a fibrous structure 12 as described herein that encapsulates a tobacco composition layer 14. The number of layers of the tobacco composition 14 and the number of layers of fibrous structure 12 can vary, and the illustrated embodiment is merely exemplary. As shown, the fibrous structure 12 can completely surround the outer surface of the tobacco composition 14, although embodiments where a smaller percentage of the outer surface of the tobacco composition is enclosed are also included in the invention. The tobacco product may optionally include an edible film 16, explained more fully below, that encapsulates the tobacco composition 14 in addition to the fibrous structure. In the illustrated embodiment, the tobacco layer 14 is in the form of a compressed tobacco sheet, although other tobacco composition types could also be used.

The tobacco composition as illustrated in FIG. 1 may be manufactured by a direct compression process or by a granulation process prior to encapsulation within the fibrous structure. The direct compression process includes a blending and processing step which may be conducted by first forming a tobacco blend. As indicated above, the tobacco may comprise a blend of various types, shapes, sizes, and cuts, or a single variety of the aforementioned tobaccos may be used instead of a blend. The tobacco may be cured or uncured. The tobacco blend is typically further processed through the use of a grinding step. The ground tobacco will typically have an average particle size of less than about 1 mm. After grinding, the tobacco component may be optionally cooked (semi-pasteurized) by any suitable technique. For example, the tobacco component can be cooked by high pressure, heat and/or steam. Other cooking techniques can also be used. Following cooking, the tobacco component may be stored at or about room temperature until needed for further processing.

According to one embodiment, the fibrous structure 12 is a warp knitted structure. Referring to FIG. 2, an expanded view of a typical warp knitted fabric 20 is illustrated. Interlinking, sequential loops 22 of a fiber or yarn are formed in an axial direction during the stitching process on a lateral array of needles with at least one separate thread being supplied to each needle. A stitch is formed by wrapping the yarn around the needle and drawing it through the previously knitted loop. This wrapping of the yarn is referred to as an "overlap." The second component of stitch formation is the length of yarn linking together the stitches which is referred to as the "under lap" and is formed by the lateral movement of the yarns across the needles.

The yarn may be manufactured from any natural or synthetic fiber that is suitable for oral introduction and capable of providing structural integrity to a tobacco composition as described herein. The warp knitted structure can be formed in a variety of shapes and sizes capable of encapsulating a tobacco composition. The warp knitted structure provides the requisite structural integrity required to retain the tobacco composition in a tight, compressed form while allowing the tobacco composition to come in contact with the user's gum, lip or cheek.

A warp knitted structure for encapsulating a tobacco composition may be prepared via a variety of techniques. See, for example, U.S. Pat. No. 2,435,897 to Newman et al.; U.S. Pat. No. 3,222,893 to Busch et al.; and U.S. Pat. No. 4,015,451 to Gajjar et al., which are incorporated by reference herein. Production may be carried out on, for example, one of two common types of warp knitting machines: the Tricot and Raschel machines. During production, the yarn is supplied to a knitting zone parallel to the selvage of the fabric (i.e. in the direction of the wales). The loops are joined together in a width-wise direction by moving the threads back and forth between adjacent needles. The needles produce parallel rows of loops simultaneously that are interlocked in a zigzag pattern. Specifically, the yarns are fed from warp beams to a row of needles extending across the width of the machine. Every knitting needle is supplied with at least one separate yarn. In order to connect the stitches to form a fabric, the yarns are deflected laterally between the needles. In this manner, a knitting needle often draws the new yarn loop through the knitted loop formed by another end of yarn in the previous knitting cycle. The resulting fabric can be produced in sheet or flat form using one or more sets of warp yarns suitable for encapsulation of a tobacco composition. The resulting fabric can be used to encircle or enclose any desired percentage of the outer surface of the tobacco composition in order to form a cohesive composite structure suitable for oral use.

According to another embodiment, the fibrous structure is a fiber reinforced composite structure manufactured according to a tailored fiber placement (TFP) process. See, for example, the tailored fiber placement technology platform available from Filacon Technologies of Winterlingen, Germany and LayStitch Technologies of Highland, Mich. See also U.S. Pat. No. 7,942,993 to Gessler et al. and US Pat. Pub. No. 2010/0126652 to Joern et al., each of which is incorporated by reference.

A fiber-reinforced composite structure may be manufactured according to a tailored fiber placement process on customary CNC-controlled automatic sewing and embroidering machines, which are also used, for example, in the textile industry. As illustrated in FIG. 3, during a tailored fiber placement process, one or more reinforcing fibers 30 are sewed by needle and thread onto a base material 32 that is held in a frame 34 (e.g., each reinforcing fiber is stitched to the base material using a sewing technique). In the present invention, the base material 32 includes a tobacco composition, such as a compressed tobacco sheet. The base material can also be a multi-layer structure that includes at least one tobacco composition layer and at least one fibrous layer (e.g., a fabric sheet). The reinforcing fibers 30 are stitched to the base material (e.g., to the tobacco composition and/or to a multi-layer structure that includes a fabric or yarn layer and a tobacco composition layer). The reinforcing fibers 30 can be laid out in a variety of directions and geometrical designs. Exemplary machines capable of adaptation to form the products of the invention are commercially available from LayStitch Technologies.

According to one embodiment, the reinforcing fibers can be laid in either a free or selective manner. A free fiber design allows for increased tensile strength thereby allowing for increased ability to hold a tobacco composition in a finite space for oral placement. A selectively laid fiber placement allows for fiber placement at a particular point for reinforcement (e.g., around perimeter of the composite structure). The stitching thread can be any biocompatible thread material known in the textile arts, such as thread formed from one of the polymer materials noted above.

According to one embodiment, the reinforcing fibers can be repeatedly laid to provide any particular area of the structure with proper reinforcement. Reinforcement can be formed specifically in zones that are subjected to particular loading, such as, for example, regions where force is introduced, by laying additional fiber strands. According to one embodiment, a tobacco composition is placed within the frame and on top of a fibrous layer, and then reinforcing fibers are stitched over the fibrous layer and through the tobacco composition. According to another embodiment, at least two fibrous layers encompass or sandwich the tobacco composition and reinforcement encapsulates the entire composite structure. According to yet another embodiment, at least two edible or soluble films adapted for oral ingestion may encapsulate the tobacco composition and the reinforcement may encapsulate the entire composite structure. The edible film includes one or more of (i) a fruit or vegetable puree and (ii) a denatured protein. The edible film or fibrous layer may further include one or more flavorant, flavor enhancer, sugar or other sweetener, souring agent, preservative, filler, pigment, or a combination thereof. Exemplary edible films are set forth, for example, in U.S. Pat. No. 5,543,164 to Krochta et al. and U.S. Pat. No. 8,048,466 to McHugh et al., as well as in U.S. application Ser. No. 13/530,145 to Sebastian et al., filed Jun. 22, 2012, all of which are incorporated by reference herein. A commercially available embodiment of an edible film suitable for use in the present invention is available from NewGem Foods, LLC of Stockton, Calif.

FIG. 4 presents a cross-sectional view of a smokeless tobacco product that includes a plurality of reinforcing fibers attached through a tailored fiber placement (TFP) process. As illustrated, the smokeless tobacco product 40 includes a base material that includes a tobacco composition 42 as described herein. The tobacco composition 42 is encapsulated by optional outer layers 44. The optional outer layers 44 may include at least one fibrous structure (e.g., a woven or non-woven fabric sheet), at least one edible film, or a combination thereof. For example, both outer layers 44 can be a fabric sheet constructed of any of the fiber types noted herein. Alternatively, both outer layers 44 could be edible films. Still further, in certain embodiments, the smokeless tobacco product 40 includes one edible film as a first outer layer 44 and one fabric sheet as a second outer layer 44. Although two outer layers are illustrated in FIG. 4, the invention also includes embodiments comprising only one outer layer 44, which can be either a fabric sheet or an edible film. A plurality of reinforcing fibers 46 are laid out on the base material in a variety of directions and geometrical designs.

According to yet another embodiment, the fibrous structure is a braided fiber sleeve. Referring to FIG. 5, the braided sleeve 50 includes a plurality of fibers 52 arranged in a criss-cross manner. The braided sleeve 50 ensures the tobacco composition located within the sleeve remains compressed or compacted, thereby restricting the tobacco composition from easily falling out of the sleeve and into a user's mouth. The physical properties of the braid (expandability, compressibility, resiliency, stretchability) can be adjusted to provide the ideal degree of flexibility and structural integrity for any particular application. The braided fiber sleeve 50 can be formed from fibers that are safe for oral use, such as those noted above.

The braided fiber sleeves as described herein can be prepared by conventional circular braiders. See, for example, U.S. Pat. No. 1,615,587 to Klein et al., U.S. Pat. No. 4,734,685 to Kite et al., U.S. Pat. No. 5,505,117 to Dunlap et al., and U.S. Pat. No. 5,749,280 to Scherzinger, which are incorporated by reference in their entirety. A circular braiding machine is composed of two rotating sets of bobbins on which fibers or yarns have been wound. One set of bobbins runs clockwise while the other bobbin runs counterclockwise around the center of the machine along a defined path. The bobbins of the two sets pass alternatively inside and outside along the path, forming a braided sleeve structure. The width of the sleeve is determined by the take-up speed of the braiding machine. According to one embodiment, the braided sleeve can be braided on a suitable mandrel or core to produce a variety of complex shapes, including flattened sleeves. A braided fiber sleeve can be manufactured such that when no external forces are applied, the sleeve remains in an unexpanded position. The sleeve can be expanded by inserting a tobacco composition. Once the tobacco composition is inserted, the braided fabric sleeve springs back thereby restricting the tobacco composition and preventing leakage of tobacco into the user's mouth. The tobacco composition can be inserted into the braided fabric structure during manufacture, such as by wrapping a compressed tobacco sheet around a mandrel and braiding the fabric onto the tobacco sheet, or after braiding by simply inserting the tobacco composition into an open end of the braided material. The braided sleeve can be stitched closed as desired to completely encapsulate the tobacco composition.

According to a further embodiment, the fibrous structure is a spacer fabric. A "spacer fabric" encompasses three-dimensional fibrous constructions that include two distinctive layers of fabric joined together by intermediate fibers to define a plurality of voids between the distinctive fabric layers. In certain embodiments, the spacer fabric is collapsible such that the spacer fabric is capable of compressing around the tobacco composition to create a cohesive product. See, for example, U.S. Pat. No. 7,060,156 to Mack et al., which is incorporated by reference herein. The fabric layers disclosed herein can be constructed uniformly or with many combinations of woven or non-woven structures and with a wide variety of fabric and yarn fiber types. The yarn fiber is preferably a material suitable for encapsulation of a tobacco composition and safe for oral use as disclosed herein. The yarn fiber structure may be ply, twisted, core-spun, core-wrapped, or commingled. The connecting layer can be formed in a variety of shapes including tubes, pleats, or other engineered forms. The choice of fiber for the connecting layer can be widely varied and the selection thereof is influenced by the mechanical characteristics of the fabric layer material so as to provide support and spacing between the fabric layers. According to one embodiment, the connecting layer fiber is the same fiber as the fiber forming the fabric layers. In an alternative embodiment, the connecting layer fiber is different from the fiber forming the fabric layers.

According to the embodiment of FIG. 6, the spacer fabric 60 includes a top layer 62, connecting layer 64, and a bottom layer 66. As illustrated, the top layer 62 and bottom layer 66 are manufactured from identical yarns with identical structures. In other embodiments, the top layer 62 and bottom layer 66 are manufactured from different yarns and have completely different structures.

As disclosed herein, the resulting spacer fabric may be formed in a variety of shapes suitable for encapsulation of a tobacco composition. According to the embodiment of FIG. 7, the spacer fabric 70 is formed in a tubular, cylindrical, or curvilinear shape whereby a tobacco composition is held in a cavity 72 defined by the spacer fabric. The tobacco composition can be placed within the cavities or voids formed in the spacer fabric between the two layers. Compression of the spacer fabric can help retain the tobacco composition (e.g., tobacco in particulate or granular form) within the fabric structure to form a cohesive composite product.

A spacer fabric may the manufactured by a variety of processes including, but not limited to, nonwoven, woven, braided, stitched, warp knitted, weft knitted techniques, or combinations there. According to one embodiment, a nonwoven spacer fabric is formed from fibers that are connected by entanglement or bonded together by a chemical, heat or solvent treatment. See, for example, U.S. Pat. No. 7,718,249 and U.S. Pat. No. 7,814,625, both to Russell et al., each of which is incorporated by reference herein.

According to one embodiment, a woven spacer fabric is formed by weaving two layers of fabric together with pile yarns binding the two layers together so as to create a hollow space between the two layers. See, for example, U.S. Pat. No. 5,413,837 to Rock et al., which is incorporated by reference. According to another embodiment, a braided spacer fabric is formed by a braiding technique whereby three or more threads interlace with one another in a diagonal formation, producing flat, tubular or solid constructions. According to another embodiment, a stitched spacer fabric is formed by a stitching process whereby stitching threads are used to join two or more fabric layers.

According to one embodiment, a warp knitted spacer fabric is formed by warp knitting techniques whereby yarns are formed in a zigzag pattern along the length of a fabric and follow adjacent columns (e.g., wales). See, for example, U.S. Pat. No. 5,385,036 to Spillane et al., which is incorporated by reference herein. A three-dimensional warp knitted fabric may be formed on a double-bed Rashel machine by knitting the top and bottom layers simultaneously on separate needle beds. During the knitting process, yarns are intermittently swapped between the separate needle beds to create a core of pile which is interconnected to the top and bottom layers. The spacer fabric thickness may be adjusted appropriately by adjusting the distance between the two needle bars.

According to yet another embodiment, a weft knitted spacer fabric may be formed from a top layer fabric and bottom layer fabric that is connected vertically with pile yarns. See, for example, U.S. Pat. No. 5,735,145 to Pernick, U.S. Pat. No. 5,284,031 to Stoll et al., U.S. Pat. No. 5,422,153 to Miyamoto, U.S. Pat. No. 5,395,684 to Robinson et al., U.S. Pat. No. 6,779,369 to Shepherd, and U.S. Pat. No. 7,611,999 to McMurray, each of which is incorporated by reference. The top layer and bottom layer fabric may be produced separately on a dial and cylinder machines using a variety of stitches. Pile yarns then connect the top layer and bottom layer by tuck stitches. Dial and cylinder machines may produce a spacer fabric that is circular knitted. Alternatively, dial and cylinder machines may produce a double or single-faced cylindrical or curvilinear shaped spacer fabric. According to yet another embodiment, a weft knitted spacer fabric may also be manufactured on a v-bed flat knitting machine. Utilization of a v-bed knitting machine allows of inclined or perpendicular pile yarns and further enables a variety of structures, combinations of different yarn materials, and further integration of one or more additional fabrics layers and pile yarns for further reinforcement.

Products of the present invention may be packaged and stored in any suitable packaging. See, for example, the various types of containers for smokeless types of products that are set forth in U.S. Pat. No. 7,014,039 to Henson et al.; U.S. Pat. No. 7,537,110 to Kutsch et al.; U.S. Pat. No. 7,584,843 to Kutsch et al.; U.S. Pat. No. 7,946,450 to Gelardi et al.; U.S. Pat. No. 8,033,425 to Gelardi; U.S. Pat. No. 8,066,123 to Gelardi; U.S. Pat. No. D592,956 to Thiellier; U.S. Pat. No. D594,154 to Patel et al.; and U.S. Pat. No. D625,178 to Bailey et al.; US Pat. Pub. Nos. 2008/0173317 to Robinson et al.; 2009/0014343 to Clark et al.; 2009/0014450 to Bjorkholm; 2009/0250360 to Bellamah et al.; 2009/0230003 to Thiellier; 2010/0084424 to Gelardi; 2010/0133140 to Bailey et al; 2010/0264157 to Bailey et al.; 2011/0168712 to Gelardi et al.; and 2011/0204074 to Bailey et al., which are incorporated herein by reference. Various manners or methods for packaging smokeless tobacco compositions are also set forth in US Patent Pub. Nos. 2004/0217024 and 2006/0118589 to Arnarp et al.; and 2009/0014450 to Bjorkholm; and PCT Pub. Nos. WO 2006/034450 to Budd; WO 2007/017761 to Kutsch et al.; and WO 2007/067953 to Sheveley et al, which are incorporated by reference herein.

Many modifications and other aspects of the disclosure set forth herein will come to mind to one skilled in the art to which the disclosure pertains having the benefit of the teachings presented in the foregoing descriptions and the associated drawings. Therefore, it is to be understood that the disclosure is not to be limited to the specific aspects disclosed and that modifications and other aspects are intended to be included within the scope of the appended claims. Although specific terms are employed herein, they are used in a generic and descriptive sense only and not for purposes of limitation.

That which is claimed:

1. A smokeless tobacco product adapted for oral consumption, comprising:

a tobacco composition; and at least one fibrous structure enclosing at least a portion of the outer surface of the tobacco composition such that the fibrous structure and the tobacco composition form a cohesive structure capable of maintaining cohesion when placed in an oral cavity, wherein the fibrous structure comprises one or more of (i) a warp knitted structure; (ii) a plurality of reinforcing fibers attached to the tobacco composition through a tailored fiber placement (TFP) process; (iii) a braided sleeve; and (iv) a spacer fabric.

2. The smokeless tobacco product of claim 1, wherein the tobacco composition comprises at least one of a cut, ground, pelletized, particulate, granular, shredded, reconstituted, extruded, cast, or compressed tobacco sheet material.

3. The smokeless tobacco product of claim 1, wherein the tobacco composition is in the form of a compressed tobacco sheet.

4. The smokeless tobacco product of claim 1, wherein the fibrous structure comprises fibers made from a material selected from the group consisting of alginate, protein, cotton, nylon, viscose, polyester, acrylics, flax, jute, bamboo, rayon, polyvinyl alcohol, starch, polyurethane, cis-polyisoprene, polyanhydride, polybutylene succinate, hybrid yarns formed containing glass fiber, and copolymers and blends thereof.

5. The smokeless tobacco product of claim 1, wherein the fibrous structure comprises fibers made from a cellulosic material or an aliphatic polyester selected from polylactic acid and polyhydroxyalkanoates.

6. The smokeless tobacco product of claim 1, wherein the fibrous structure encloses at least about 50% of the outer surface area of the tobacco composition.

7. The smokeless tobacco product of claim 1, wherein the fibrous structure encloses at least about 90% of the outer surface area of the tobacco composition.

8. The smokeless tobacco product of claim 1, wherein the fibrous structure comprises a warp knitted structure.

9. The smokeless tobacco product of claim 1, wherein the fibrous structure comprises a plurality of reinforcing fibers attached to the tobacco composition through a tailored fiber placement (TFP) process.

10. The smokeless tobacco product of claim 1, wherein the fibrous structure comprises a braided sleeve.

11. The smokeless tobacco product of claim 1, wherein the fibrous structure comprises a spacer fabric.

12. The smokeless tobacco product of claim 11, wherein the spacer fabric comprises two fabric layers joined together by a plurality of intermediate fibers and defining voids between the two fabric layers, wherein the tobacco composition is positioned within the voids of the spacer fabric.

13. The smokeless tobacco product of claim 1, further comprising an edible film, wherein the edible film at least partially encapsulates the tobacco composition.

14. The smokeless tobacco product of claim 1, further comprising at least one edible film or fabric sheet positioned adjacent to the tobacco composition to form a multi-layer structure, and wherein a plurality of reinforcing fibers are positioned on the surface of the multi-layer structure and attached thereto.

15. A process for preparing a smokeless tobacco product adapted for oral consumption, comprising the step of enclosing at least a portion of the outer surface of a tobacco composition with a fibrous structure to form a composite structure capable of maintaining cohesion when placed in an oral cavity, wherein the fibrous structure comprises one or more of (i) a warp knitted structure; (ii) a plurality of reinforcing fibers attached to the tobacco composition through a tailored fiber placement (TFP) process; (iii) a braided sleeve; and (iv) a spacer fabric.

16. The process of claim 15, wherein the tobacco composition comprises at least one of a cut, ground, pelletized, particulate, granular, shredded, reconstituted, extruded, cast, or compressed tobacco sheet material.

17. The process of claim 15, wherein the tobacco composition is in the form of a compressed tobacco sheet.

18. The process of claim 15, wherein the fibrous structure comprises fibers made from a material selected from the group consisting of alginate, protein, cotton, nylon, viscose, polyester, acrylics, flax, jute, bamboo, rayon, polyvinyl alcohol, starch, polyurethane, cis-polyisoprene, polyanhydride, polybutylene succinate, hybrid yarns formed containing glass fiber, and copolymers and blends thereof.

19. The process of claim 15, wherein the fibrous structure comprises fibers made from a cellulosic material or an aliphatic polyester selected from polylactic acid and polyhydroxyalkanoates.

20. The process of claim 15, wherein the fibrous structure encloses at least about 50% of the outer surface area of the tobacco composition.

21. The process of claim 15, wherein the fibrous structure encloses at least about 90% of the outer surface area of the tobacco composition.

22. The process of claim 15, wherein the fibrous structure comprises a warp knitted structure and the enclosing step comprises placing the tobacco composition within a cavity formed within the warp knitted structure and compressing the warp knitted structure around the tobacco composition.

23. The process of claim 15, wherein the fibrous structure comprises a plurality of reinforcing fibers attached to the tobacco composition through a tailored fiber placement (TFP) process that comprises the step of stitching each reinforcing fiber to the tobacco composition.

24. The process of claim 15, wherein the fibrous structure comprises a braided sleeve, and wherein the enclosing step comprises placing the tobacco composition within a cavity formed within the braided sleeve and compressing the braided sleeve around the tobacco composition.

25. The process of claim 15, wherein the fibrous structure comprises a spacer fabric, and the enclosing step comprises placing the tobacco composition within the spacer fabric and collapsing the spacer fabric around the tobacco composition.

26. The process of claim 25, wherein the spacer fabric comprises two fabric layers joined together by a plurality of intermediate fibers and defining voids between the two fabric layers, and wherein the enclosing step comprises placing the tobacco composition within the voids of the spacer fabric.

27. The process of claim 15, wherein the fibrous structure comprises a plurality of reinforcing fibers attached to the tobacco composition through a tailored fiber placement (TFP) process, and wherein the composite structure further comprises at least one edible film or fabric sheet positioned adjacent to the tobacco composition to form a multi-layer structure, such that the tailored fiber placement process comprises positioning the plurality of reinforcing fibers on the surface of the multi-layer structure and stitching each reinforcing fiber thereto.

* * * * *